United States Patent [19]

Spurrier

[11] Patent Number: 4,944,530

[45] Date of Patent: Jul. 31, 1990

[54] VEHICLE SEAT BELT METAL BUCKLE TEMPERATURE INSULATING COVER

[76] Inventor: Kevin H. Spurrier, 2205 Ridgecrest Dr., Richardson, Tex. 75080

[21] Appl. No.: 328,680

[22] Filed: Mar. 27, 1989

[51] Int. Cl.[5] ..... A44B 11/00; B60R 22/00

[52] U.S. Cl. ..... 280/801; 280/808; 297/482

[58] Field of Search ..... 280/801, 804, 806, 808; 297/482

[56] References Cited

U.S. PATENT DOCUMENTS

| | | | |
|---|---|---|---|
| 4,070,038 | 1/1978 | Bergman et al. | 297/482 |
| 4,452,469 | 6/1984 | Rogers, Jr. | 280/801 |
| 4,638,534 | 1/1987 | Sasaki et al. | 280/801 |
| 4,678,205 | 7/1987 | Wold | 297/482 |
| 4,693,495 | 9/1987 | LaPointe | 280/808 |
| 4,741,574 | 5/1988 | Weightman et al. | 297/482 |
| 4,786,080 | 11/1988 | Jay | 280/808 |
| 4,795,190 | 1/1989 | Weightman et al. | 280/808 |

*Primary Examiner*—Richard A. Bertsch

*Attorney, Agent, or Firm*—Warren H. Kintzinger

[57] ABSTRACT

A protective and decorative, snug fitting temperature insulative wrap cover for the metal buckles of automotive seat belts and covers for shoulder harness metal couplings. These covers that can be quite colorful protects a seat belt and shoulder harness user in a car from hot burning hand contact with sun heated metal buckles or in the winter with chillingly cold metal buckles. In addition the material of the covers may be coated or impregnated with luminscent material for improved visibility ease of location in the dark of night.

13 Claims, 2 Drawing Sheets

VEHICLE SEAT BELT METAL BUCKLE TEMPERATURE INSULATING COVER

Figure 1A:
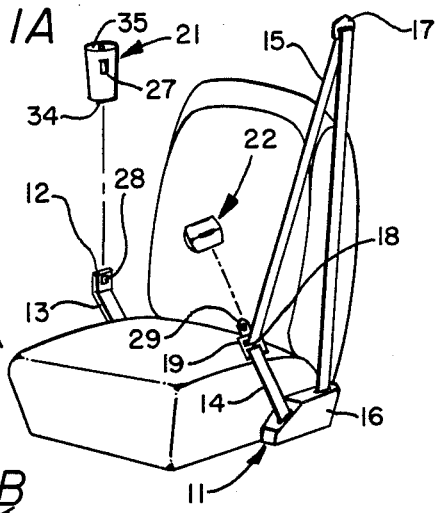

This invention relates in general to automotive seat belt metal buckles and shoulder harness couplings, and more particularly, to buckle and harness coupling temperature insulating covers.

Metal buckles and couplings used with seat belts and shoulder harnesses used in vehicles become very hot when exposed to the summer sun and conversely extremely cold to the touch in winter time. Hard plastic covers used in an attempt to cover buckles and shoulder harness couplings are subject to breakage deterioration that occurs with the differences between thermal expansion characteristic between the plastic material used and the metal buckles and shoulder harness couplings through the range and frequency of temperature variation encountered in the vehicle environment - winter through summer, day and night. Another problem with seat belts buckles and shoulder harness couplings is that they are hard to find in the dark many times at night.

It is therefore a principal object of this invention to provide vehicle seat belt metal buckle and shoulder harness metal coupling insulating covers.

Another object is to via use of such metal buckle and coupling covers, prevent heat burning of hands in the heat of summer and hand contact with chillingly cold metal buckles in the winter time.

A further object is to via such temperature insulative covers make manual buckling of seat belt buckles and shoulder harness couplings easier.

Still another object of such covers is to make the covers visible in the dark with cover material made visible with luminescent material.

Features of the invention useful in accomplishing the above objects include, in a vehicle seat belt metal buckle, or shoulder harness coupling, temperature insulative covers, a protective and decorative snug fitting temperature insulative wrap cover for the metal buckles of automotive seat belts and covers for shoulder harness metal couplings. These covers that can be quite colorful protects a seat belt and shoulder harness user in a car from hot burning hand contact with sun heated metal buckles or in the winter with chillingly cold metal buckles. In addition the material of the covers may be coated or impregnated with luminescent material for improved visibilty ease of location in the dark of night.

Specific embodiments representing what are presently regarded as the best modes of carrying out the invention are illustrated in the accompanying drawings.

Figure 3:
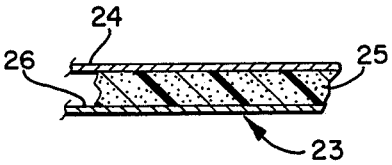
Figure 1B:
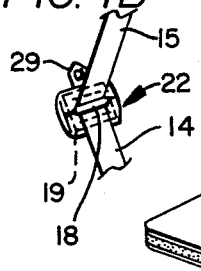
Figure 2:
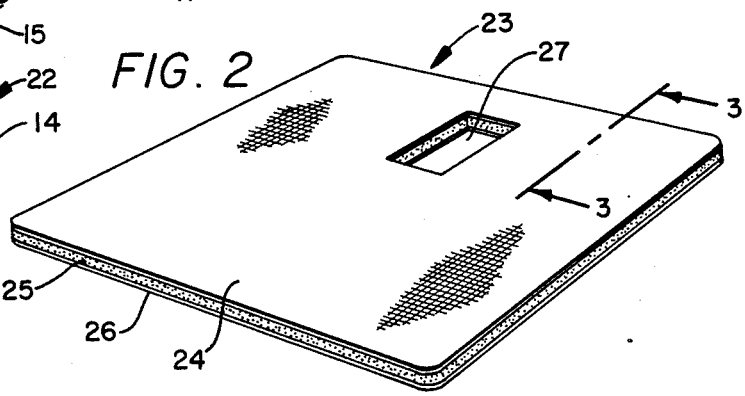
Figure 4:
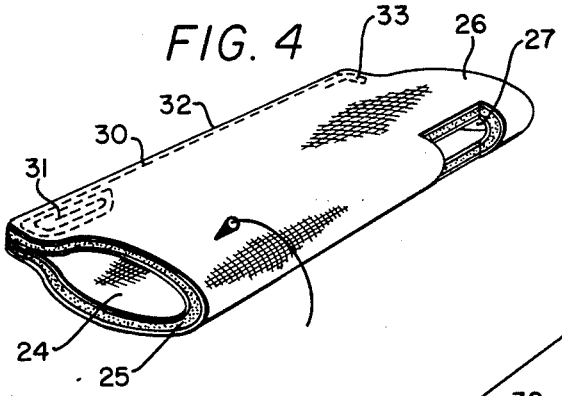
Figure 5:
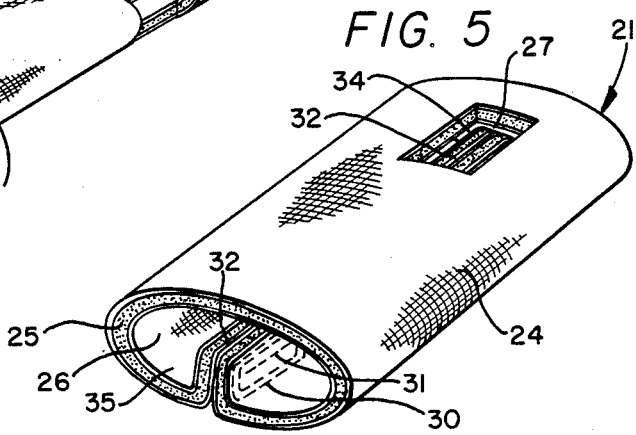
Figure 6:
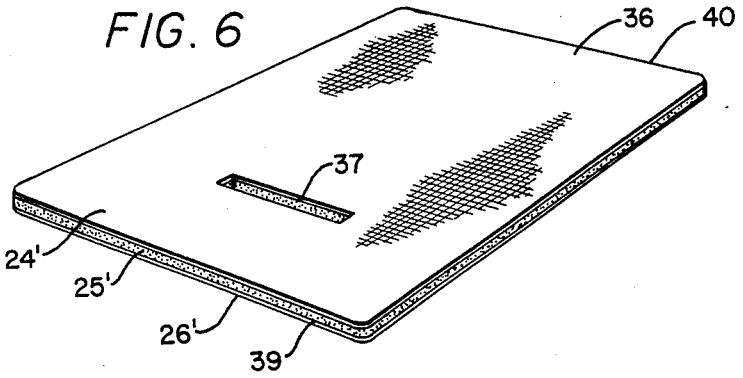
Figure 7:
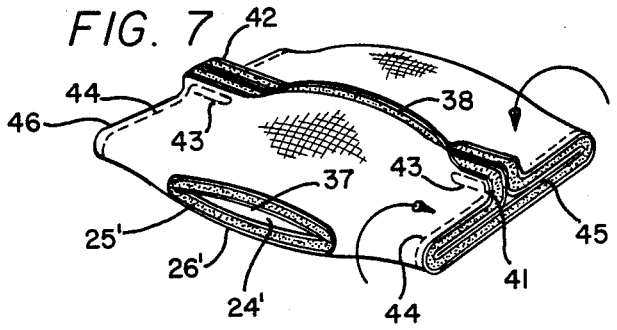
Figure 8:
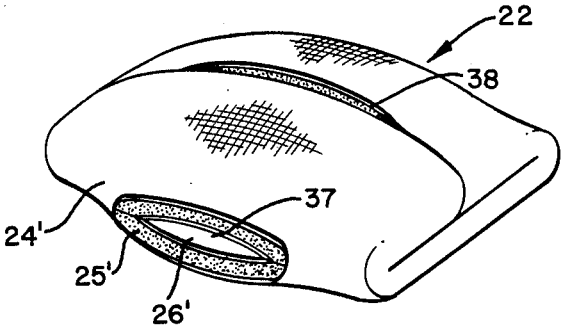

In the drawings:

FIG. 1A represents a perspective view of a vehicle seat equipped with a seat belt and shoulder harness with seat belt buckle and harness coupling both provided with temperature insulative covers;

FIG. 1B, an enlarged perspective view of the harness coupling and cover;

FIG. 2, a perspective view of a vehicle belt buckle insulative cover material cutout;

FIG. 3, a partial cross-section view taken along line 3—3 of FIG. 2 showing cover material detail;

FIG. 4, a perspective view of the seat buckle insulative cover with the opposite edges sewn together;

FIG. 5, a perspective view of the seat belt buckle insulative cover in its finished useable form turned inside out from the state of FIG. 4;

FIG. 6, a perspective view of a shoulder latch insulative cover material cutout;

FIG. 7, a perspective view of a shoulder latch insulative cover with opposite side end edges sewn together; and FIG. 8, a perspective view of the shoulder latch insulative cover in its finished useable form turned inside out from the state of FIG. 7.

Referring to the drawings:

The vehicle seat 10 of FIG. 1A is shown to be equipped with a seat belt structure 11 with seat belt metal buckle 12 on one side mounted on the fastening end of a upward extended strap section 13 and a combination seat belt 14 and shoulder harness belt 15 both extended from a mount member 16 at the left bottom of the seat 10. The shoulder harness belt 15 extends up to and through a top mounting bracket 17 and down to a connection 18 through shoulder harness metal coupling 19 to extendable seat belt section 14 of belt 15. The seat belt metal buckle 12 has a removable temperature insulative cover 21 and the shoulder harness metal coupling 19 has a removable temperature insulative cover 22 that generally is made of the same material as cover 21. Temperature insulative cover 22 is mountable on a shoulder harness metal coupling 19 as shown in FIG. 1B.

Referring now to FIGS. 2–5 detail of the seat belt metal buckle 12 removeable temperature insulative cover 21 is shown including construction details from the insulative cover material cutout 23 of FIG. 2 to the finished seat buckle 12 removeable insulative cover 21 of FIG. 5. The insulative cover material cutout 23 is a cutout rectangle of three layer 24, 25 and 26 bonded together material with layer 24 an outside layer of (LYCRA) a tightly woven resiliently stretchable cloth, layer 25 an intermediate layer of foamed (NEOPREN) plastic, and layer 26 an inner sleeve of NYLON. The insulative cover material cutout 23 rectangle is provided with a through rectangular opening 27 for through manual access to buckle release button 28 for release of coupling tongue 29 from connection insertion in buckle 12. The cutout 23 is folded over and stitched 30 as shown in FIG. 4 with the stitching loop 31 extended further into the material from the stitched together edge 32 at the end remote from opening 27 than the shorter stitch loop 33 in order that the end opening 34 be larger than end opening 35 when the insulative cover 21 is turned inside out to the final useable finished state of FIG. 5. End opening 35 being smaller than end opening 34 enables the cover 21 to be positioned in place on seat belt metal buckle 12 without it sliding up or down from its proper position covering the buckle 12 on upward extended strap section 13 so the perspective showing of FIG. 5 is correctly in conformance with the cover 21 showing in FIG. 1 with one end smaller than the other.

Referring also to FIGS. 6, 7 and 8 detail of the shoulder harness metal coupling removeable temperature insulative cover 22 is shown including cover material cutout 36 of FIG. 6, to the finished shoulder latch insulative cover 22 of FIG. 8. The insulative cover material cutout 36 is a cutout rectangle of three layer 24', 25' and 26' bonded together material with layer 24' an outside layer of (LYCRA) a tightly woven resiliently stretchable cloth, layer 25' an intermediate layer of foamed (NEOPREN) plastic, and layer 26' an inner sleeve of NYLON. The insulative cover material cutout 36 rectangle is provided with a through slot 37 for extension therethrough of a coupling tongue 29 and also in the finished cover 22 a slot 38 through which shoulder harness belt 15 and the seat belt extension section 14 thereof extend on to and through shoulder harness metal coupling 19. The cut out 36 is folded ends 39 and 40 toward each other with the fold for end 39 being along slot 37 and with end 40 folded to end to end adjacency with folded end 39 with opposite side portions 41 and 42 thereof stitch sewn 43 together leaving the center opening 38. Additional side edge stitching 44 is provided to close the opposite side edges 45 and 46 after which the cover 22 is turned inside out to the final useable finished state of FIG. 8.

It should be noted that the outside layers 24 (24') of tightly woven resiliently stretchable cloth are treated, when desired, with a luminescent material for improved visibility ease of location in the dark of night. The luminescent material may be either in the form of a coating or an impregnation material carried by the outside layer 24 (24').

Whereas this invention has been described with several embodiments thereof, it should be realized that various changes may be made without departure from the essential contributions to the art made by the teachings hereof.

What is claimed:

1. A vehicle passenger protective belt metal connector temperature insulative cover comprising: a multi-layer folded over and stitched cover sized and configured to cover a first belt metal connector with first opening means in said cover for connection of a section of said belt to said metal connector; and second opening means in said cover for connection of said metal connector to a second connector on a second section of said belt; wherein said multi-layer material folded over and stitched cover is a three layer material cover with an outside layer a tightly woven resiliently stretchable cloth, an intermediate layer of foamed plastic, and an inner layer of tightly woven material.

2. The vehicle passenger protective belt metal connector temperature insulative cover of claim 1, wherein said outside layer of tightly woven resiliently stretchable cloth is a material under the name LYCRA, the intermediate layer of foamed plastic is NEOPREN, and said inner sleeve of tightly woven material is NYLON.

3. The vehicle passenger protective belt metal connector temperature insulative cover of claim 1, wherein a rectangular insulative cover material cut out is used to produce said multi-layer material folded over and stitched cover; and said rectangular insulative cover material cut out is provided with an opening.

4. The vehicle passenger protective belt metal connector temperature insulative cover of claim 3, wherein said opening is a rectangular opening; said cut out is folded over and stitched to join opposite side edges of said cut out that is then turned inside out to a finished form; and with said rectangular opening positionable opposite a seat belt buckle release button when the cover is placed on a seat belt buckle.

5. The vehicle passenger protective belt metal connector temperature insulative cover of claim 4, wherein said outside layer of tightly woven resiliently stretchable cloth carries luminescent material for improved visibility ease of location in the dark of night.

6. The vehicle passenger protective belt metal connector temperature insulative cover of claim 4, wherein said rectangular opening is located adjacent one end of said cover; said first opening means is an end opening in said cover adjacent said rectangular opening; and said second opening is an end opening in said cover remote from said rectangular opening.

7. The vehicle passenger protective belt metal connector temperature insulative cover of claim 6, wherein the stitching joining opposite side edges of said cut out is extended further into the cover structure at said second opening than is the stitching at said first opening so that said first opening in said cover is larger than said second opening.

8. The vehicle passenger protective belt metal connector temperature insulative cover of claim 7, wherein said cover generally tapers from said first opening end to said second opening end.

9. The vehicle passenger protective belt metal connector temperature insulative cover of claim 3, wherein said temperature insulative cover is a shoulder harness metal coupling removeable temperature insulative cover.

10. The vehicle passenger protective belt metal connector temperature insulative cover of claim 9, wherein opposite ends of said rectangular insulative cover material cut out is folded over to end to end adjacency with said opening being in the form of a slot located at the fold over bend of that end half of said cut out.

11. The vehicle passenger protective belt metal connector temperature insulative cover of claim 10, wherein opposite side portions of adjacent ends of the fold over portions are stitch sewn together leaving a center slit opening; additional side edge stitching closing opposite side edges after which the cover is turned inside out to a finished form.

12. The vehicle passenger protective belt metal connector temperature insulative cover of claim 11, with said center slit opening positioned for a combination shoulder harness and seat belt connection through the slit opening with a shoulder harness metal coupling enclosed within said cover with a coupling tongue extended through said slot.

13. The vehicle passenger protective belt metal connector temperature insulative cover of claim 12, wherein said outside layer of tightly woven resiliently stretchable cloth carries luminescent material for improved visibility ease of location in the dark of night.

* * * * *